United States Patent [19]

Haas

[11] 4,136,666

[45] Jan. 30, 1979

[54] FIREPLACE CONSTRUCTION

[76] Inventor: Willard A. Haas, R.D. #2, Box 60B, Oley, Pa. 19547

[21] Appl. No.: 773,466

[22] Filed: Mar. 2, 1977

[51] Int. Cl.[2] ..... F24B 13/02

[52] U.S. Cl. ..... 126/143

[58] Field of Search ..... 126/120, 121, 143, 242, 126/243, 244, 245, 112, 85 B

[56] References Cited

U.S. PATENT DOCUMENTS 2,819,711 1/1958 Robinson ..... 126/143

FOREIGN PATENT DOCUMENTS 439281 12/1935 United Kingdom ..... 126/143

883526 11/1961 United Kingdom ..... 126/143

*Primary Examiner*—Ronald C. Capossela

*Attorney, Agent, or Firm*—M. Richard Page

[57] ABSTRACT

A fireplace is disclosed in which the ash dump is utilized to supply combustion air to the fireplace so that air will not be drawn by the fireplace from the room in which the fireplace is located. This is accomplished by locating an air diffuser over the ash dump in combination with an ash pit clean-out door that can be adjusted to control the flow of air through the ash dump and into the fireplace. The ash pit clean-out door may be located either on an outside wall to draw in outside air or it may be located in a non-living area of a home, such as the basement.

6 Claims, 3 Drawing Figures

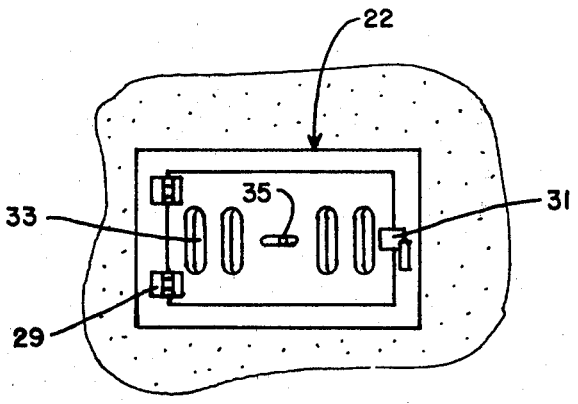
FIG. 3
FIG. 1
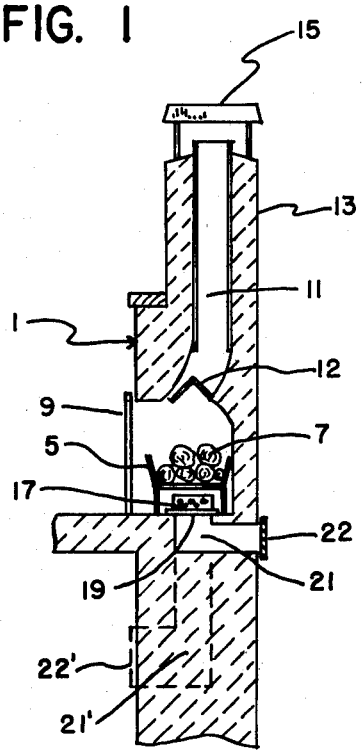
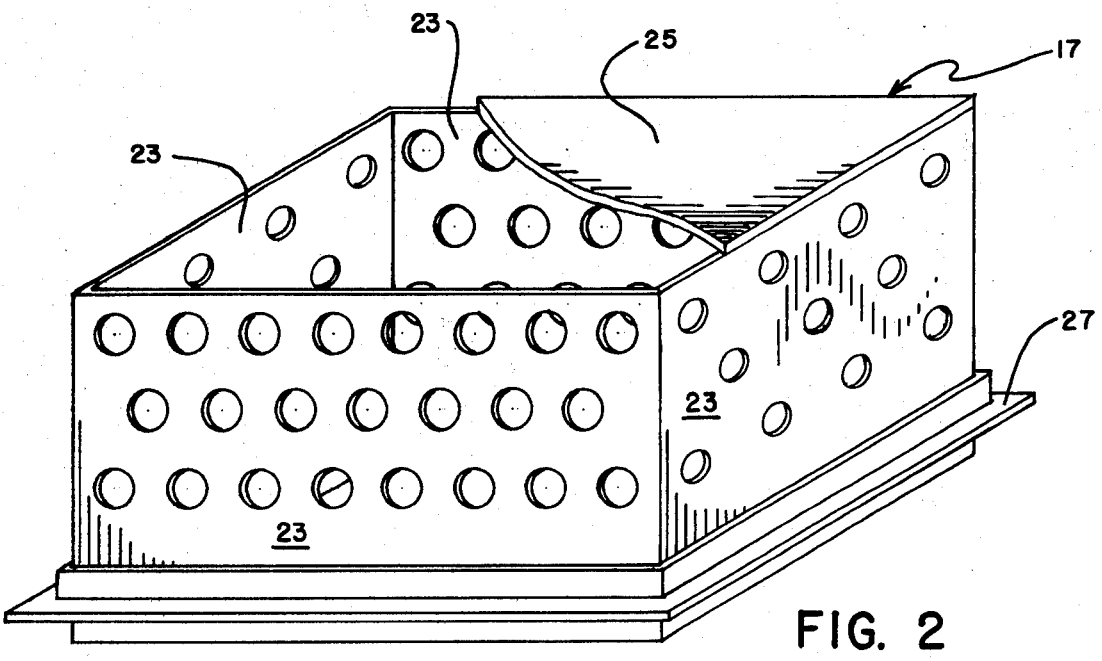
FIG. 2

FIREPLACE CONSTRUCTION

BACKGROUND OF THE INVENTION

1. Field of the Invention

This invention relates to improved fireplaces in which means are provided for supplying combustion air to the fireplace from a point remote from the room in which the fireplace is located so that heated air will not be withdrawn from a home during operation of the fireplace.

2. Description of the Prior Art

It has long been recognized that a fireplace is not a particularly efficient means for producing heat for a home or other building. Conventional fireplaces may actually place an added burden on the central heating system of a home because the air to support combustion is drawn from the room into the fireplace and vented up the chimney. The air withdrawn from the room necessarily must be replaced by outside air which seeps into the home variously through windows, doors, electric outlets and the like, and this flow of air will cause a draft through the house that will cool those portions of the house that are not immediately adjacent the radiant glow of the fire. This draft may also be felt on the floor even in the immediate vicinity of the fireplace. Some studies have even indicated that fireplaces may withdraw as much or more heat than they supply, and so, realistically, it must be said that fireplaces have little practical value other than their nostalgia and aesthetic charm.

In older types of construction, before energy costs soared to such extravagant levels, houses were not always well insulated and the air withdrawn from the house by a fireplace was not noticeable in view of the otherwise naturally drafty condition of the house. However, now that greater concern is being shown for the conservation of energy and the reduction of heating bills, houses are being built much more tightly and better insulated so that the draft effect of removing air from the house in the form of combustion air has become a more readily recognized problem.

The prior art has long recognized (for example, see Patent 948,007) that fireplaces can be operated more efficiently if air is supplied to the fireplace from outside the house. It has also been recognized (see U.S. Pat. No. 3,180,332) that in addition to supplying air from outside the house, it may be advantageous to supply the combustion air from remote locations, such as unheated foundation crawl-spaces and basement areas which are usually at lower temperatures than the living areas of a house. One of the more recent patents relating to the use of outside air is U.S. Pat. No. 3,845,754 that additionally discloses the use of a tempered glass screen which, when closed, prevents any air from being withdrawn from the fireplace room while, at the same time, allows the fire to heat the room by radiation and permits aesthetic enjoyment of the fire.

Another advantage of a fireplace as shown in U.S. Pat. No. 3,845,754 lies in the fact that when the tempered glass screen is in the shut position, the fire may be left unattended and allowed to die down overnight, and, even though the flue is not closed, no warm air will be drawn out of the house through the chimney.

While the above and other known improved fireplaces are generally effective in improving the heating and combustion efficiency, they suffer from several disadvantages. For example, these fireplaces require special conduits, as through outside walls, which cannot be installed without considerable inconvenience except at the time the house and fireplace are built. Another disadvantage of the prior art fireplaces of the type with which this invention is concerned lies in the fact that they do not provide for effective distribution of incoming combustion air or control over the rate and efficiency of combustion.

SUMMARY OF THE INVENTION

It is the principal object of this invention to provide a fireplace that will supply meaningful heating values to a home.

Another object of this invention is to provide a fireplace that does not draw combustion air from the house to cause drafts and impose an additional load on a central heating system.

Yet another object of this invention is to provide means for controlling and directing the flow of combustion air into a fireplace to control the rate and improve the efficiency of combustion.

And still another object of this invention is to provide inexpensive means which will provide for easy means to convert an existing firplace into one in which the combustion air can be furnished from a location remote from the living areas of a home.

Briefly, these and other objects are accomplished by utilizing the ash pit conventionally located below a central portion of the grate as a conduit to supply combustion air to the fireplace. In the preferred practice of this invention, the trapdoor of the ash dump is removed and replaced by a gas-pervious air distribution means that serves both to distribute combustion air to the fireplace efficiently and also to prevent hot ashes from falling into the ash pit when there is a fire in the fireplace. To control the amount of combustion air drawn into the fireplace, the ash pit door is replaced with the door of a type which will enable regulation of the amount of air that flows through the door and into the ash pit. By these means, the ash pit performs the dual functions of facilitating the removal of ashes from the hearth and providing a convenient source of combustion air whether the ash pit clean-out door is located on an outside wall behind the fireplace or at a point remote from the living areas of the house such as the basement.

DESCRIPTION OF THE DRAWINGS

The invention may be more fully understood by the following description of the drawings in which:

FIG. 1 is a side sectional view of a fireplace constructed in accordance with this invention;

FIG. 2 is a perspective view, partially broken away, of a preferred air-diffusing means for use in the fireplace of this invention; and FIG. 3 is a front view of an ash pit clean-out door suitable for use in the practice of this invention.

In FIG. 1, a fireplace 1 made in accordance with this invention is illustrated having a combustion chamber 3 and a grate 5 located within the combustion chamber 3 to support the fuel 7 being burned, such as firewood or coal. The combustion chamber 3 is enclosed on its front side, in the preferred practice of this invention, by a fire screen 9 which is made of heat-resistant tempered glass. The fireplace 1 is provided, as is conventional, with a chimney flue 11, a control damper 12, and a chimney 13 which is protected by a baffle 15.

An air distribution box 17 rests upon the ash dump orifice 19 on the floor of the combustion chamber 3 under the middle region of the grate 5. The air distribution box 17 is open on its bottom so that it can freely communicate with ash pit 21. Access to ash pit 21 is provided by an ash dump clean-out door 22 located on the outside wall of the house. Alternatively, as shown by the dotted lines, an ash pit 21' may extend vertically down into a basement or other non-living area of a home, in which case access to ash pit 21' is obtained by means of ash dump clean-out door 22'.

The air distribution box 17 is provided with upstanding perforate side walls 23—23, a solid cover plate 25, and a flanged base 27 adapted to rest on the ash dump 19. Alternatively, instead of providing a solid top 25 for the air distribution box 17, a removable cover or swinging trap door may be used for convenience in shoveling ashes from under the grate 5 into the ash dump 21.

In FIG. 3, one embodiment of an ash dump clean-out door 22 is shown in which the door is hinged as at 29 and secured in the closed position by a latch 31. Variable orifices 33 are provided in the clean-out door 22 and are here illustrated as openings in the front of the door which are similar to openings in a moveable plate (not shown) mounted on the back of the door. When the rear plate is slid back and forth by control handle 35, the effective area of the orifices 33 can be controlled to adjust the amount of combustion air that reaches the combustion chamber 3 via the clean-out door 22 and the ash pit 21.

From the above description of the drawings, it is believed that it can be understood how the objects of this invention are achieved by the illustrated devices. Outside air (or air from a non-living space) is controllably introduced through the ash dump clean-out door 22 to provide combustion air, via the ash pit 21, to the air distribution box 17. Since the air distribution box 17 is located directly under the grate 5, efficient use is made of the combustion air. Also, since the air passages of the air distribution box are on vertical surfaces, the air distribution box is an effective barrier to prevent hot ashes from falling into the ash pit 21 when the fireplace is in operation. By these means, particularly if an imperforate fire screen 9 is used, no air will be withdrawn from the room in which the fireplace is located, whether or not the fireplace is in operation. This is of further utility in that one can leave the fire unattended to burn itself out without concern that hot air will be withdrawn from the room through the chimney after the fire has gone out even if damper 12 is not shut. The placement of the air distribution box at a central portion under the grate yields greater efficiency in combustion, and, when used in combination with the adjustable louvres on the ash dump clean-out door 22 provides a simple control over the rate of combustion.

Since many existing fireplaces are provided with ash dumps and clean-out doors, the invention provides a simple and economic means to convert existing fireplaces to more efficient ones without expensive alterations. All that need be done is to replace the ash dump trapdoor with the air distribution box of this invention and replace the ash dump clean-out door with one that has control means, such as louvres, to regulate the amount of combustion air that is fed to the fire chamber.

While the air distribution means 17 has been shown and described as being a substantially box-like structure with orifices along its vertical walls, the shape is not important so long as it can be fitted over the ash dump opening. Also, it is not essential that the air distribution means 17 have upstanding walls, as it could, for example, be a flat plate. In this instance, however, it would be well to reduce the size of the orifices in the air distribution means to reduce the likelihood of live ashes falling into the ash pit when the fireplace is being used. This construction may be disadvantageous as air passing through the plate may cause considerable disturbance to the ashes on the floor of the combustion chamber.

I claim:

1. A fireplace having a flue, a grate, an ash dump located under the grate, and an ash pit having a clean-out door located below the ash dump, the improvement comprising, in combination, an air diffuser mounted over the ash dump, the air diffuser comprising a hollow box extending upwardly from the ash dump toward the grate, having an open bottom, a top, and perforate side walls to permit the passage of air, and the clean-out door having associated air-control means.

2. A fireplace in accordance with claim 1 wherein the clean-out door is located on an outside wall.

3. A fireplace in accordance with claim 1 wherein the clean-out door is located in a non-living area.

4. A fireplace according to claim 1 wherein the top of the air diffuser is substantially closed.

5. A fireplace in accordance with claim 4 wherein the mounting means comprises a flanged base adapted to rest on the ash dump.

6. A fireplace in accordance with claim 1 wherein the air diffuser includes mounting means removable retaining the air diffuser in the ash dump with the side walls thereof extending above the dump.

* * * * *